US005139619A

United States Patent [19]

Schoonover

[11] Patent Number: 5,139,619

[45] Date of Patent: Aug. 18, 1992

[54] COVER LIFTING DEVICE

[75] Inventor: R. E. Schoonover, Custer, Wash.

[73] Assignee: Atlantic Richfield Company, Los Angeles, Calif.

[21] Appl. No.: 667,722

[22] Filed: Mar. 11, 1991

[51] Int. Cl.[5] ..... B66C 23/18

[52] U.S. Cl. ..... 202/270; 202/239; 212/166; 212/223

[58] Field of Search ..... 202/239, 261, 262, 241, 202/270, 250, 251; 212/166, 223, 251; 414/744.6

[56] References Cited

U.S. PATENT DOCUMENTS 1,540,630 6/1925 Jenks et al. ..... 212/223
3,379,623 4/1968 Forsythe .
3,751,854 8/1973 Huwyler et al. .
3,944,472 3/1976 Lowe .
3,966,060 6/1976 Andrews et al. ..... 202/262
4,126,520 11/1978 Horster .
4,225,393 9/1980 Gregor et al. .
4,552,622 11/1985 Kwasnik et al. .
5,035,336 7/1991 Schmitz et al. ..... 212/166

*Primary Examiner*—Joye L. Woodard
*Attorney, Agent, or Firm*—Tom F. Pruitt

[57] ABSTRACT

An apparatus and method for raising, moving and lowering a massive coker chute cover are provided. One embodiment of the invention comprises engaging the cover with a lift plate, raising the lift plate, and, moving the lift plate, the course of the movement being in the arc of a circle, lowering the lift plate, and releasing the cover from the plate.

6 Claims, 1 Drawing Sheet

COVER LIFTING DEVICE

BACKGROUND OF THE INVENTION

I. Field of the Invention

This invention relates to delayed coking operations. In one aspect, this invention relates to a method of discharging coke from a coke drum. In another aspect, this invention relates to a device to remove a cover from a coker discharge chute.

II. Prior Art

Delayed coking is a well-known process. Typically, each coker comprises a vertically-oriented cylindrical drum. The drum has a top head and a bottom head covering and sealing the top and bottom, respectively, of the drum. The drum is a massive vessel, typically about twenty-six feet in diameter and about eighty-six feet tall. The top head and the bottom head also are massive devices, being about six feet in diameter and each weighing approximately two and one-half tons.

Heavy liquid hydrocarbon feed to the coker typically is preheated in a heater to a temperature in the range of about 700°to 900° F. The feedstream is thermally cracked in the coke drum for an extended period of time during the coking cycle to produce gas and gas oil and other hydrocarbon product streams of various boiling ranges and to form porous carbonaceous petroleum coke. The gas and normally liquid product streams are removed as vapors during the coking cycle from the top of the drum, and the coke remains in the drum at the end of the coking cycle. The hydrocarbon feed is switched from the coke drum to a second parallel coke drum while the first drum is taken off-line, and coke is removed from the first drum.

Hydrocarbon feed to each coker is typically fed to the on-line coke drum through an inlet port which is typically incorporated into the drum bottom head, and product vapor streams exit the vessel through process an outlet port, which is typically incorporated in the top head.

To remove the coke from the off-line drum, the top head and bottom head of the drum are removed, and the coke is coke is cut from the drum and allowed to fall through a coke discharge chute which is located directly below the drum. The discharge chute is a large conduit, typically about six feet in diameter, and typically about thirty to thirty-five feet long. The discharge chute lets the coke fall and pass to a storage area. During the coking cycle, the discharge chute is covered with a large cover, typically in the form of a manhole-type cover plate or grate, to avoid the inadvertent falling or passage of objects into the coke discharge chute. This cover is removed after the coking cycle so the cut coke can fall into the discharge chute.

After the end of the coking cycle, after both the top and bottom heads and the chute cover are removed, the coke in the drum is cut by hydraulic water jets. First, a vertical pilot hole is drilled through the core of the coke to provide a channel for coke discharge through the bottom opening of the coke drum. Then, the hydraulic jet is directed against the upper surface of the coke at a distance from the central discharge core and cuts the coke into pieces, which pieces fall out of the drum, through the pilot hole, into the coke discharge chute which passes or conveys the coke pieces to coke storage areas The cutting jet is moved in both a circular and vertical pattern until all of the coke is cut and falls from the drum into the discharge chute and on to coke storage.

The cut coke ranges in size from large (e.g. four to eight inch diameter) lumps to smaller, fine pieces and is admixed with spent cutting water. Typically, as the coke drum discharge, comprising coke lumps, fines and cutting water, falls through the discharge chute, the discharge is passed over slotted or perforated segments of the chute, with the cutting water and coke fines draining off through the slots in the chute and the coke lumps are passed to coke storage.

As discussed above, the coke discharge chutes for conveying coke removed from the coker are positioned substantially below the bottom of the coke drum, and during the coking cycle, a cover, typically in the form of a safety plate or grate, is placed over the entrance to the coke discharge feed chute to prevent entry of materials into the chute. Since the cover blocks the entry to the coke discharge chute, the cover must be moved at the end of each coking cycle before coke can be discharged from the drum to the chute. The cover must be replaced after coke discharge and during the coking cycle. The coke discharge chute entry cover is also a relatively large device, being approximately six feet in diameter and weighing in the range of about one hundred fifty to two hundred pounds.

Each coking cycle generally is approximately 24 to 48 hours long, and each chute entry cover must be first removed and then replaced as part of each coking cycle.

Prior art devices and processes for engaging, lifting, and conveying a coker chute cover during removal and replacement have been both labor-intensive and time-intensive. One widely-used commercial method of lifting and moving the chute cover employs a wheeled cart, in particular a coke drum deheading cart. The deheading cart is basically a sturdy, rolling cart adapted to receive and have a removed drum bottom head rest on the upper support surface of the cart. The cart is also adapted to engage, lift, and hold the chute cover. During coke removal, the cart is rolled away from the area beneath the coker to move the bottom head and chute cover from the discharge zone. Numerous ergonomic and practical operating problems are associated with this cart and method. Before the cart can lift the chute cover, the cover must be aligned beneath the cart and then be engaged by the cart bottom, then lifted upwards to the bottom of the cart and be conveyed by the cart, without becoming disengaged from or falling from the cart. To replace the chute cover, the cart, carrying the cover beneath it, must be rolled over the chute opening and have the cover aligned with the chute opening so that the cover can be lowered over the opening. This method and apparatus for moving the chute cover are both cumbersome and undesirable.

SUMMARY OF THE INVENTION

In accordance with this invention, a new method for removing, moving, and replacing a coker chute cover has been found. I have discovered that coker chute covers can be lifted and conveyed by the apparatus of this invention and without use of a deheading cart or any other type of wheeled device. This invention permits the safe and stable lifting, moving, and then later lowering of the heavy chute cover, while limiting the motion of the chute cover in both the horizontal and vertical directions. By use of the apparatus and method of this invention, the heavy chute cover can be picked up, moved, and replaced in its original location with high speed and precision.

DESCRIPTION OF PREFERRED EMBODIMENTS

Figure 1:
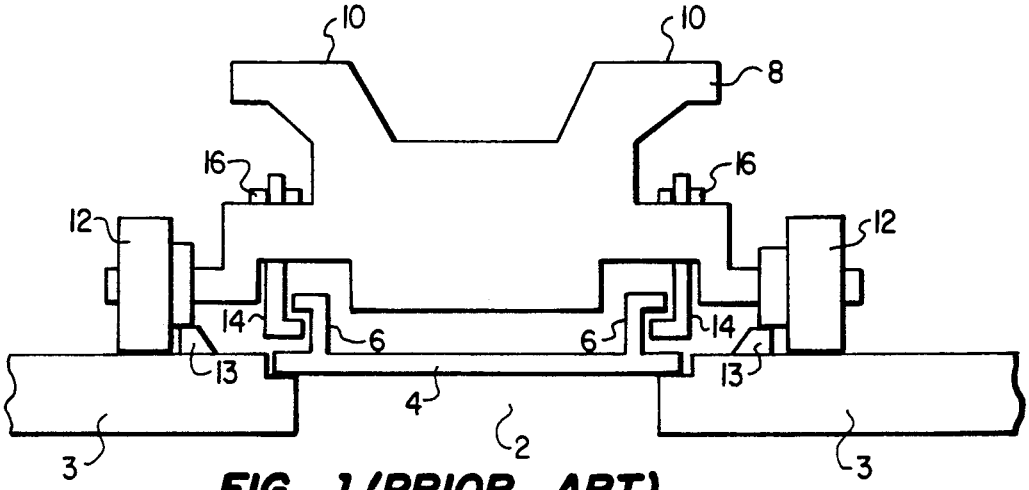
FIG. 1 (PRIOR ART)

In one embodiment of this invention, an apparatus for lowering and raising and moving a coker chute cover, comprises a shaft, a lift arm operably connected at one end to the shaft and moveable about the shaft, a connecting means positioned along the lift arm and connectable to the coker chute cover, and, a drive means to lower and raise the connecting means, wherein the drive means is positioned to move concurrently with the lift arm. In one variation of this embodiment, the shaft is affixed to the work platform in the coker base area in proximity to the coke chute cover, and the lift arm is operably connented at one end to the shaft by a hinge, which hinge has two ends. One end of which hinge is affixed to the shaft and one end is affixed to the lift arm so that the lift arm is moveable about the shaft. In another preferred variation of this embodiment, the shaft is substantially cylindrical and the lift arm comprises at one end a cap, which cap comprises a cylindrical hollow tube portion which is adapted to fit the lift arm perpendicular to the extension of the lift arm and one end of the cap is closed, the diameter of the cylindrical portion of the cap being selected so that the cap fits over the shaft. In this variation, the lift arm is free to swing about the shaft. In still another variation of this embodiment of this invention, the connecting means is positioned along the lift arm at the end of the lift arm opposite to the lift arm cap. Preferably, the connecting means is a cable which is connectable to the coker chute cover by hook, clasp, tie, magnetic connector, or other connector. In one variation, the connecting means is operably connected to a winch which is driven by a drive means, such as an electric motor, which rotates the winch to lower and raise the connecting means, wherein the drive means is positioned to move concurrently with the lift arm.

In another embodiment of this invention, an apparatus for lowering and raising and moving a coker chute cover having a cover lift arm comprises a support member and a lift arm pivotable about the support member, wherein the lift arm comprises a lift arm guide. The support member and lift arm are preferably of tubular construction, and the lift arm is preferably extended perpendicular to the support member, and lift arm guide is located along the length of the lift arm and extended parallel to the support member in a direction toward the coker chute cover. The apparatus of this embodiment further comprises a lift plate comprising a lift plate guide, the lift plate being adapted to engage the cover lift arm, and the lift plate guide preferably being extended parallel to the support member upward from the lift plate and being adapted to either surround and enclose or be surrounded by and enter the lift arm guide. The lift plate guide preferably directs the movement of the lift plate in a direction determined by the lift arm guide. More, preferably at least two guides are used, with one guide located at or near one end of the lift arm and the lift plate respectively, and one guide located at or near the opposite end of the lift arm and the lift plate, respectively, with the guides operating to direct the upward and downwards motion of the lift plate in a direction parallel to the lift arm, even when the weight of the chute cover is applied to the lift plate and lift arm. The apparatus of this embodiment also comprises a lift cable operably connected to the lift plate, and preferably the lift cable is also operably connected to the lift arm. A drive means is operably connected, by pulleys, to the lift cable to move the lift cable and move the lift plate. Preferably, the drive means is positioned along the lift arm and moves concurrent with movement of the lift arm. For additional stability, the apparatus of this embodiment may further comprise a load arm which is operably connected, at one end of the load arm, to the lift arm and, at the other end of the load arm, to the support member at a point either above or below the point of connection of the lift arm to the support member. Still more preferably, the drive means comprises a drive arm which is moved by the drive means and comprises a pulley through which the lift cable passes, wherein the pulley is positioned at one end of the drive arm and movement of the drive arm moves the lift cable and moves the lift plate. Preferably also, the lift arm comprises a pulley through which the lift cable passes and movement of the drive arm moves the lift cable and moves the lift plate.

In still another embodiment of this invention, a process for raising, moving and lowering a coker chute cover from a first position to a second position and then to the first position comprises engaging the cover with a lift plate; raising the lift plate; and, moving the lift plate from a first position to a second position, the course of the moving or movement being in the arc of a circle; moving the lift plate from the second position to the first position, with the course of moving or movement being in the arc of a circle, lowering the lift plate, and releasing the cover from the plate. Preferably, the lift arm is supported by a support member, wherein the support member is substantially vertical and the lift arm is perpendicular to the support member and moveable around the support member, and the lift plate is engaged with the chute cover and the lift plate and the cover are raised while the movement of the lift plate and cover are guided to move in a direction substantially parallel to the lift arm. The lift arm, lift plate, and cover are pivoted about the support member from the first position to the second position during coke cutting and discharge, then prior to the coking cycle, are pivoted from the second position back to the first position; and, the lift plate and cover are lowered while the movement of the lift plate and cover are guided in a direction substantially parallel to the lift arm to replace the chute cover in its original location.

BRIEF DESCRIPTIONS OF DRAWINGS

Figure 2:
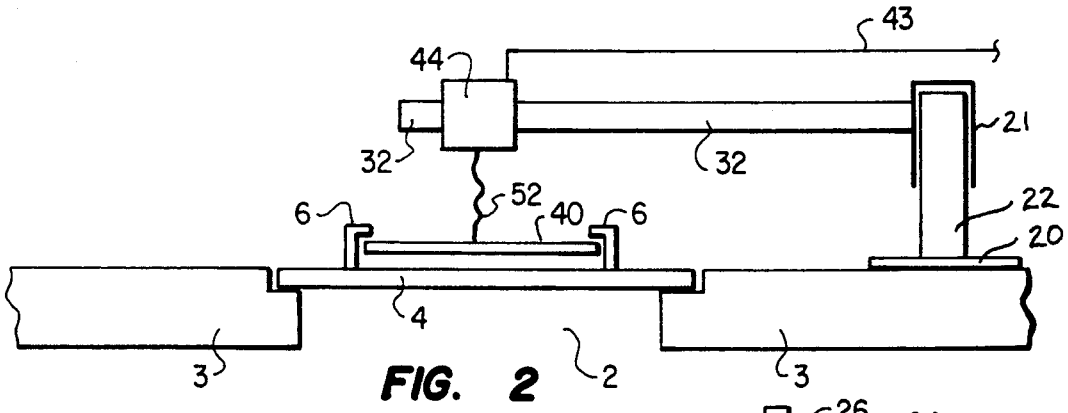
Figure 3:
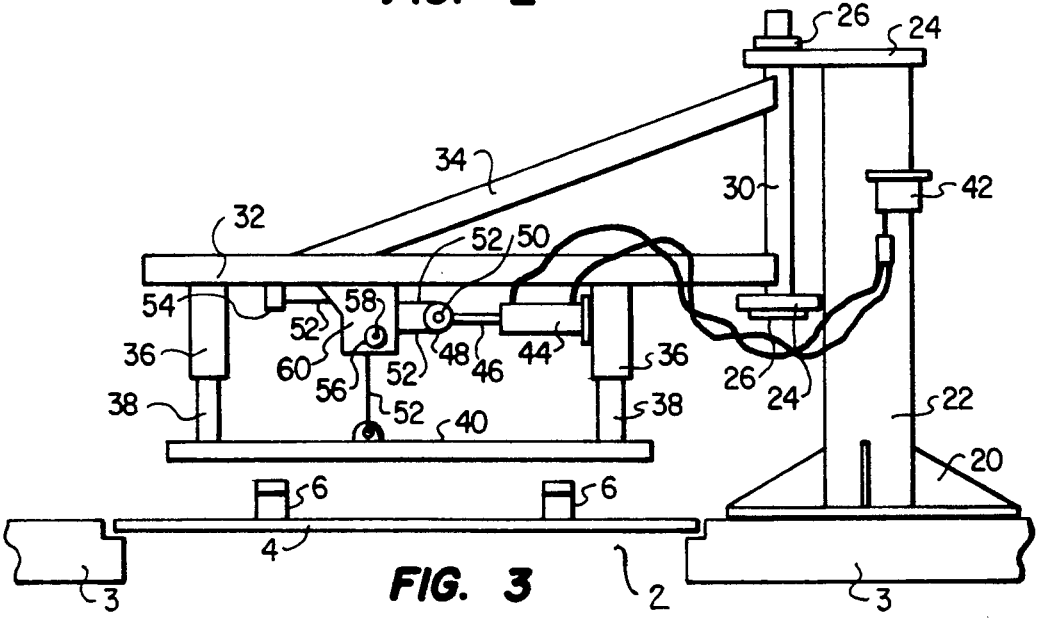

The invention is illustrated with reference to the drawings wherein, for purposes of illustration, it being understood that this invention is not limited thereto. FIG. 1 is a schematic showing a side view of the cart apparatus of the prior art for removing and moving a coker chute cover. FIGS. 2 and 3 are side views of different embodiments of this invention. In FIGS. 1, 2 and 3, the drawing figures are not necessarily to scale and certain elements are shown in generalized or somewhat schematic form in the interest of clarity and conciseness.

In FIG. 1, coke drum discharge chute 2 located in the coker base platform 3 area is covered by a chute cover 4 which has two cover arms 6. The deheader cart 8, comprising bottom head support stand 10 where the drum bottom head (not shown) is placed after removal from the coke drum. The cart 8 also comprises wheels 12 wherein the cart is rolled, either with or without guide rails 13, into place under the coke drum during bottom head removal or cover 4 lifting. As the cart 8 is rolled into place under the coke drum, cover lift arms 14 are placed in the proximity of cover arms 6. Lifting means 16, such as hydraulic cylinder or threaded connection means, are operably connected to the lift arms 14 such that the lift arms are raised to engage the cover arms 6 of chute cover 4 in such manner that the chute cover 4 is raised from the chute 2. The cart 8 is moved in substantially a straight line direction, since a turning movement could direct the cart wheels 12 in to the chute 2, and as the cart 8 is moved, the chute cover 4, held by the lifting arms 14, is moved. Those skilled in the art readily appreciate the difficulties associated with this prior art method of removing the chute cover 4. The cart 8 user has a blocked or restricted view of the chute cover 4 since the cart 8 must be placed directly over the cover 4 to engage and lift the cover 4. The cover 4, and arms 6, if not properly aligned and engaged with the cart 8 lifting arms 14, results in lifting only one side of the cover 4 or dropping of the cover 4 while the cart 8 is moved. Other difficulties are associated with unequal or unlevel raising or lowering by the lifting means 16 of the arms 14, which can also result in dropping and/or incorrect placement of the cover 4.

FIG. 2 is a schematic representation of one embodiment of this invention, showing an apparatus for lowering and raising and moving a coker chute cover. The coke discharge chute 2 in the coker base platform 3 area is covered by chute cover 4 which comprises arms 6. The apparatus of this invention comprises a base 20, a support member 22, such as a shaft, and a lift arm 32 operably connected at one end to the shaft 22 by means of a cap 21 and moveable about the shaft 22, and further comprises a connecting means 52 such as a winch-deployed cable positioned along the lift arm 32 and connectable to the coker chute cover 4, and, a drive means, such as a winch, 44 to lower and raise the connecting means 52 and the lifting plate 40 which is affixed to the cable 52, wherein the drive means 44 is positioned to move concurrently with the lift arm 32. In this embodiment, the drive means 44 is an electrically operated motor operated by electrical power source 43 and the connecting means 52 is a winch cable driven by the drive means 44. As the drive means 44 extends or retracts the cable 52, the lifting plate 40 and the cover 4 can be raised and lowered. In the raised position, the cover 4 can be moved from its first position over the chute 2 to a second position away from the chute 2 by pushing on the lift arm 32, which is rotatable about the support member 22.

FIG. 3 is another schematic representation of another embodiment of this invention, showing an apparatus for lowering and raising and moving a coker chute cover. The coke discharge chute 2 is covered by chute cover 4 which comprises arms 6. A base 20 is operably connected to the coker based level platform floor 3 area in the proximity to the chute cover 4. Those skilled in the art realize that this can be affixed to the floor 3 or to a wall or other suitable support. The base 20 is operably connected to a support member 22 having a bearings support member 24 comprising bearings 26. A shaft 30 is operably connected to pivot lift arm 32, and providing additional support to the pivot lift arm 32 is load arm 34 which is connected to the shaft 30 and the pivot lift arm 32. Bearings 26 permit shaft 30 to rotate and swing pivot lift arm 32. Attached to pivot lift arm 32 are cylinder guides 36, which are adapted to receive lift plate insert guides 38 which are affixed to lift plate 40. The lift plate insert guides 38 are preferably moveable up and down freely within the cylinder guides 36. Lift plate 40 is adapted to receive and contact, engage or interlock chute cover 4 arms 6. Power source 42 is connected to drive means 44, such a hydraulic cylinder, comprising drive arm 46, having a drive arm shaft 50, and drive arm pulley 48 which is free to rotate around drive arm shaft 50. Lift cable 52 is connected at one end to the lift plate connector 54 and passes over and around pivot lift arm pulley 56. The pivot lift arm pulley 56 is free to rotate around pivot lift arm pulley shaft 58 which is supported by a pivot lift arm pulley support 60, connected to the pivot lift arm 32. Lift cable 52 which is connected at one end to lift plate connector 54 is connected at its other end to the lift plate 40 passing over the lift arm pulley 56 rotatably supported on the pivot lift arm pulley support 60. Since the lift cable 5 a fixed length, as the drive means 44 extends the drive arm 46, the lift plate 40 is lowered. As the drive means 44 retracts the drive arm 46, the lift plate 40 is raised. In one preferred variation of this embodiment of this invention, after the coking cycle and before coke cutting and discharge, the pivot lift arm 32 is pushed to rotate the shaft 30 which allows the arm 32 to turn about the support member 22 until the lift plate 40 is located under the cover 4 arms 6. The power source 42 applies power to the drive means 44 to retract the drive arm 46, then the lift plate 40 is raised by lift cable 52 and the chute cover 4 is lifted by its arms 6 and the lift plate 40. After the cover 4 is lifted, the pivot lift arm 32 is pushed to rotate the shaft 30 which allows the arm 32 to turn about the support member 22 until the lift plate 40 which is holding the cover 4 is located away from the chute entrance 2. After coke discharge into the chute entrance 2 is completed, the pivot lift arm 32 is pushed to turn the shaft 30 about the support member 22 until the lift plate 40 which is holding the cover 4 is located over the chute entrance 2. With power from the power source 42 applied, the drive means 44 extends the drive arm 46, and the lift plate 40 and chute cover 4 are lowered in place over the chute entrance 2.

Reasonable variations and modifications which will become apparent to those skilled in the art can be made in this invention without departing from the spirit and scope thereof.

What is claimed is:

1. An apparatus for raising, moving, and lowering a coker chute cover, comprising:

a. a support member;

b. a lift arm having two ends, operably connected at one end to said support member and pivotable about said support member, which lift arm includes a lift arm guide extending downward from said lift arm;

c. a lift plate which includes a lift plate guide extending upward from said lift plate, which lift plate guide engages said lift arm guide and directs movement of said lift plate in a direction determined by said lift arm guide;

d. a lift cable having a fixed length and two cable ends, connected at one cable end to said lift plate and connected at the other cable end to said lift arm; and e. a drive means, which is positioned along said lift arm and moves concurrently with said lift arm, which drive means is operably connected to said lift cable which drive means moves said lift cable and which lift cable moves said lift plate.

2. An apparatus in accordance with claim 1 comprising a load arm having two ends, which load arm which is operably connected at one end to said lift arm and at one end to said support member.

3. An apparatus in accordance with claim 1 wherein said drive means includes a movable drive arm which drive arm includes a drive arm pulley through which said lift cable passes, wherein said drive arm moves said lift cable and moves said lift plate.

4. An apparatus in accordance with claim 3 wherein said lift arm includes a lift arm pulley support and lift arm pulley through which said lift cable passes.

5. An apparatus in accordance with claim 1 wherein said lift arm is extended perpendicular to said support member, said lift arm guide is extended downward from said lift arm parallel to said support member and said lift plate guide is extended upward from said lift plate parallel to said support member toward said lift arm.

6. An apparatus in accordance with claim 1 wherein said support member includes a bearings support member, bearings supported by said bearings support member, and a shaft rotatable with said bearings, wherein one end of said lift arm is connected to said shaft of said support member.

* * * * *